United States Patent [19]

Sorenson et al.

[11] Patent Number: 4,748,297

[45] Date of Patent: May 31, 1988

[54] ROTARY SWITCH

[75] Inventors: Richard W. Sorenson, Avon; Milton N. Ives, Wolcott, both of Conn.

[73] Assignee: Carlingswitch, Inc., West Hartford, Conn.

[21] Appl. No.: 945,880

[22] Filed: Dec. 22, 1986

Related U.S. Application Data

[63] Continuation-in-part of Ser. No. 884,545, Jul. 11, 1986, abandoned.

[51] Int. Cl.[4] ..... H01H 19/58

[52] U.S. Cl. ..... 200/11 J; 200/277; 200/43.08

[58] Field of Search ..... 200/11 R, 11 A, 11 B, 200/11 C, 11 G, 11 S, 11 K, 16 C, 16 D, 155, 276, 277, 43.08

[56] References Cited

U.S. PATENT DOCUMENTS

| | | | |
|---|---|---|---|
| 1,873,527 | 8/1932 | Anfinnsen et al. | 200/11 J |
| 2,834,842 | 5/1958 | LeBeau | 200/11 K |
| 3,294,929 | 12/1966 | Johnson | 200/11 J |
| 3,346,707 | 10/1967 | Bock et al. | 200/277 X |
| 3,394,236 | 7/1968 | Grundig et al. | 200/11 J |
| 3,803,370 | 4/1974 | Garcia | 200/11 J |
| 3,974,348 | 8/1976 | Lipschutz | 200/277 X |
| 3,983,352 | 9/1976 | Ellis, Jr. et al. | 200/11 J |
| 4,258,237 | 3/1981 | Beck | 200/11 J |
| 4,639,562 | 1/1987 | Fredrickson | 200/43.08 |

FOREIGN PATENT DOCUMENTS

| | | | |
|---|---|---|---|
| 2824584 | 12/1979 | Fed. Rep. of Germany | 200/11 J |

*Primary Examiner*—J. R. Scott

*Attorney, Agent, or Firm*—McCormick, Paulding & Huber

[57] ABSTRACT

A miniature rotary switch having nested terminals in its bottom wall, and a disc shaped movable contact element arranged in a rotatable member such that a portion of the disc periphery rolls and slides across fixed contacts defined by the upper ends of these terminals. The rotatable member is restrained from movement axially in a cylindrical chamber defined for it by either a one piece housing, or in a key switch version by a two piece housing.

39 Claims, 9 Drawing Sheets

ROTARY SWITCH

CROSS REFERENCE TO RELATED APPLICATION

This application is a continuation-in-part of an original application having the same title, Ser No. 884,545, filed July 11, 1986 and assigned to the same assignee herein, now abandoned.

SUMMARY OF INVENTION

This invention relates generally to rotary switches and deals more particularly with a rotary switch having minimal cross sectional size with a plurality of circumaxially spaced electrical connection terminals nested in a unique pattern at one end. The other end comprises a knob in one version or a key operated plug in another.

In one form the invention has a two piece cylindrical body portion and a generally cylindrically shaped control member or actuator rotatably supported therebetween. In other versions the body portion is of one piece construction with retaining means provided to secure the control member in rotatable relationship inside an upwardly open cylindrical cavity defined for this purpose in the body portion. A slotted self defined post defined on the control member fits into the base of the body portion to hold these elements together. Another version has the self defined slotted post on the base with the post fitting a hole in the control member. In the key operated version the control member is coupled to the selectively rotatable lock cylinder and the body portion of the switch is made in two parts that are secured together by complementary shaped protuberances and openings defined in part by the two body parts.

In accordance with the preferred present invention a generally cylindrical dielectric plastic body portion defines a cylindrical cavity with a bottom wall having a plurality of openings for receiving the fixed contacts or terminals. A control member or actuator has at least one downwardly open generally rectangularly shaped recess that is spaced radially from the axis of rotation of the control member a distance corresponding to the radial spacing of the fixed contacts provided in the bottom wall of the housing itself. A disc shaped movable contact is provided in the recess so that the disc is free to rotate on its own central axis oriented perpendicular to the axis of the control member. The disc is also free to translate longitudinally of the recess to provide a peripheral portion of the disc in abutting relationship to at least one, and in the stable switch positions to the upper ends of two adjacent fixed contacts. Means is provided to bias the disc contact downwardly towards these fixed upper ends. The means so biasing the disc contact comprises a retainer that is also slidably received for translation in the recess of the control member. The retainer has a concave lower surface for engaging the periphery of the movable contact disc opposite that portion of the disc periphery which engages the fixed contact upper ends. A compression spring is also provided in the recess and acts on the retainer to urge it and the disc toward the fixed contact upper ends.

The fixed contacts preferably comprise flat metal components each of which has a lower terminal portion protruding below the bottom wall of the body portion for connection to a conductive lead or the like, and each component further includes an upper portion offset radially inwardly with respect to the lower terminal portion to define the fixed contact upper end that is adapted to be engaged by the movable disc contact. These fixed contacts are provided in equally spaced circumaxial relationship in the body portion and each such component is oriented at approximately 45 degrees with respect to a radial direction relative to the cylindrical body portion.

In one embodiment the rotary switch is further characterized by an upper cap portion for the cylindrical body portion with means being defined in part by the cap and in part by the body portion for holding these portions in assembled relationship. The control member is rotatably supported therebetween. An upstanding stem portion of the control member projects through a top opening in the cap portion to receive a knob or the like. The cap portion has a threaded boss which also provides convenient means for the rotary switch to be mounted in a panel opening.

In a second embodiment the control member has a depending central post received in a central bore defined for this purpose in the bottom wall of body portion. A retaining device secures the post against movement axially upwardly of the bore. In this version the control member may be so shaped as to itself define the manually movable knob for rotating the control member in the switch body portion.

In still another embodiment the control member past has a spade shape lower end that is slotted and retained in the central bore. This post is deformed at assembly so that an external flange abuts an annular flange defined in the bottom of the body portion to hold these members in assembled relationship while allowing rotation of the control member in the cylindrical cavity of the body portion.

In a key switch version the cap portion has a top opening to receive a lock cylinder and rotation of the key causes corresponding rotation of the control member to alter switch condition.

In a double pole version of the rotary switch means is provided for stopping the rotation of the control member in the body portion to limit rotation to approximately 180 degrees and provide two downwardly open rectangular recesses, each with a disc shaped movable contact member biased downwardly for selective engagement with adjacent fixed contact upper ends.

Other switch versions provide other ranges of travel witn other electrical combinations for the terminals.

DETAILED DESCRIPTION OF FIGS. 1–14

Figure 1:
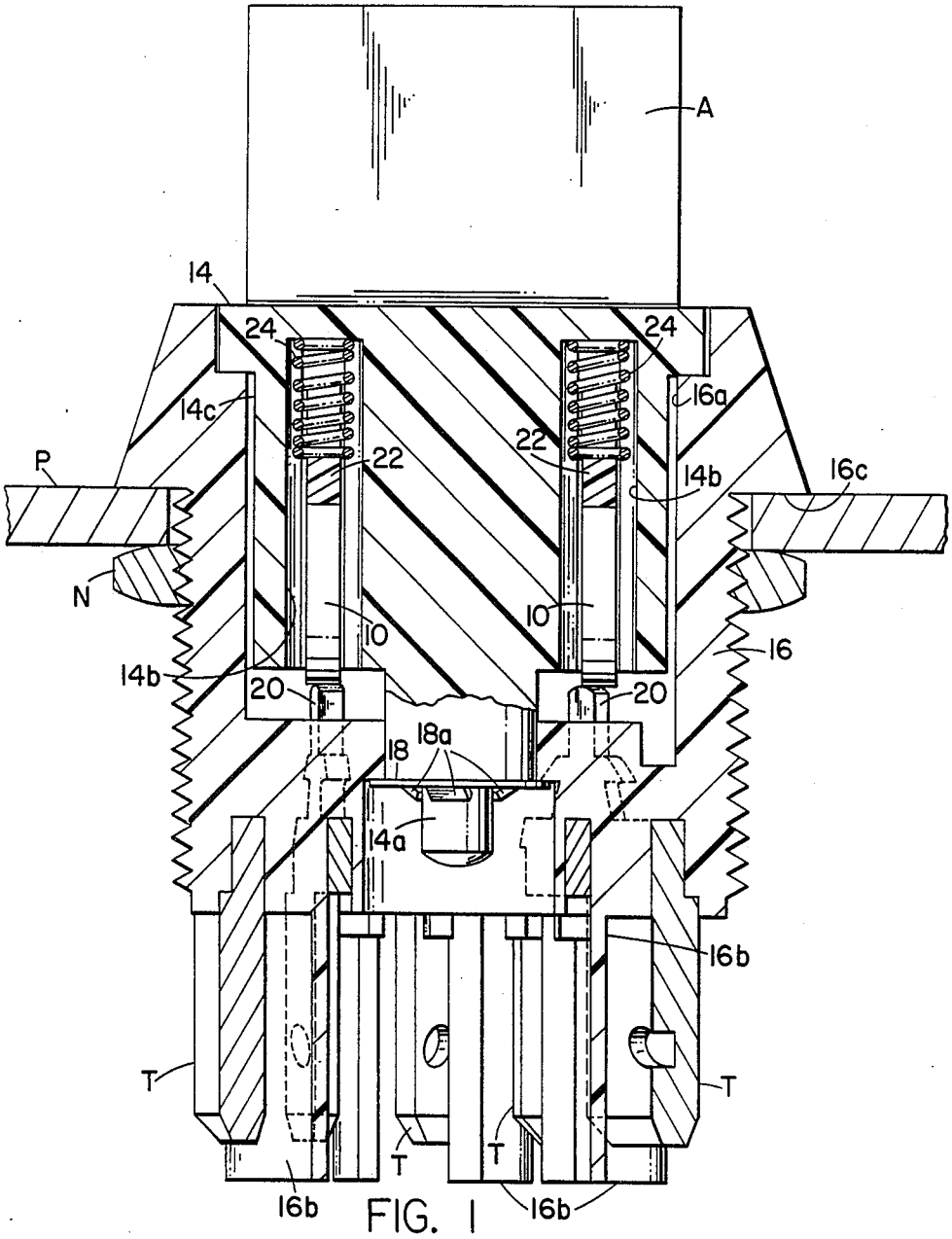
FIG. 1 shows in vertical cross section an assembled rotary switch constructed in accordance with one version of the present invention.
Figure 10:
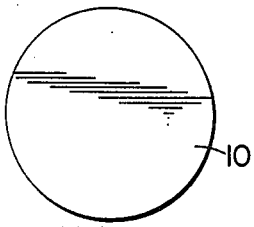
FIG. 10 is an elevational view of the movable contact disc illustrated in FIGS. 1 and 4.

Turning first to a detailed description of the embodiment illustrated in FIGS. 1–13 inclusively, FIG. 1 illustrates in vertical section a preferred form of the present invention embodied in a rotary switch having two poles and eight fixed terminals T, T that are selectively interconnected in adjacent pairs by rotation of a knob A defined at the top of actuator 14. In this version of rotary switch a cylindrically shaped body portion 16 has an annular flange 16*c* and threaded body for mounting the switch in a panel P as shown in FIG. 1.

Figure 4:
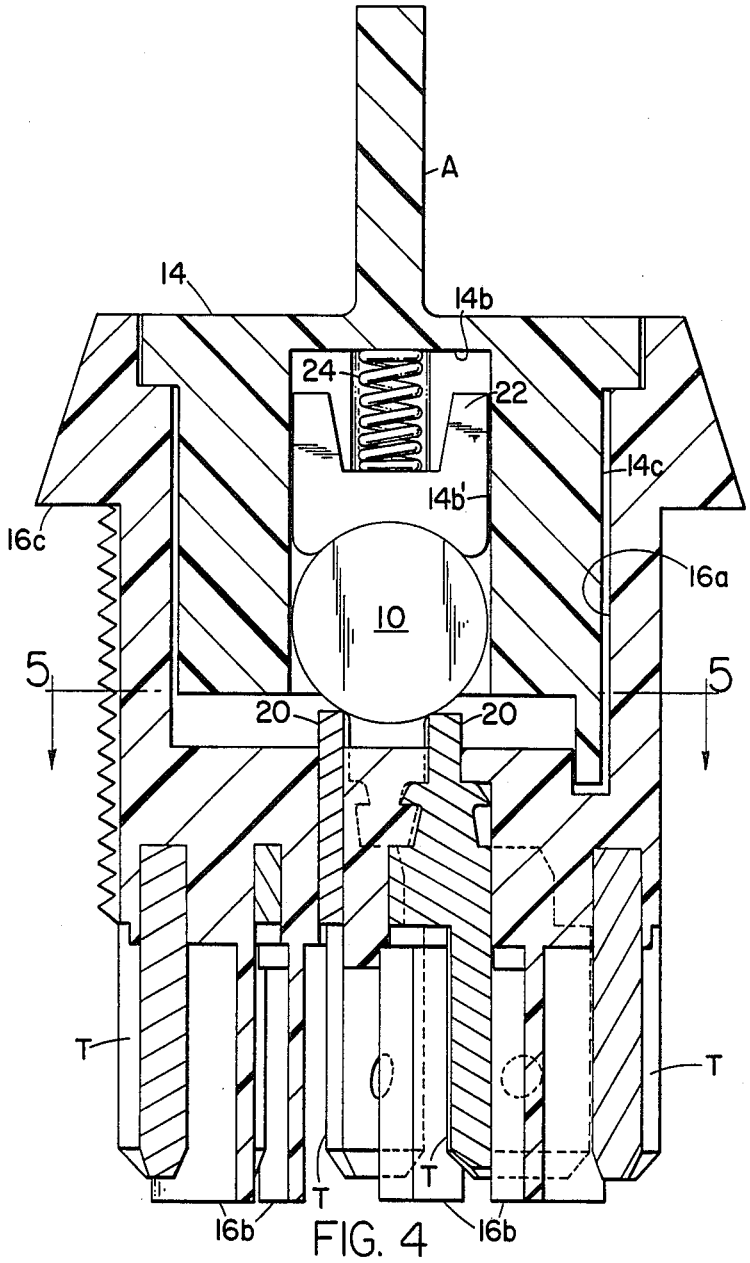
FIG. 4 is a vertical sectional view through the switch of FIGS. 1-13 inclusively being taken generally on the line 4—4 of FIG. 5.

As best shown in FIG. 4 each terminal T is defined at the lower end of a fixed contact 20 that includes an upper end which is selectively connected to the upper end of an adjacent terminal by a movable contact in the form of a disc 10. The disc 10 is shown in greater detail in FIGS. 10 and 11, and the configuration fixed contact 20 is shown in greater detail in FIGS. 8 and 9.

The terminals T, T are arranged in a circumaxially spaced pattern such that each terminal is oriented at approximately 45 degrees with respect to a radial line through the longitudinal center line of two adjacent terminals as suggested generally by the lines 12 and 13 respectively. Each line 12 and 13 in FIG. 5 can be seen to form a 45 degree angle with respect to the orientation of the associated terminals T, T as shown in that view. This geometry provides a nested configuration for the terminals T, T and contributes to the overall minimization of the cross sectional area of the resulting rotary switch. These terminal defining fixed contacts are flat components that occupy a minimum of space in the switches disclosed herein.

Figure 3:
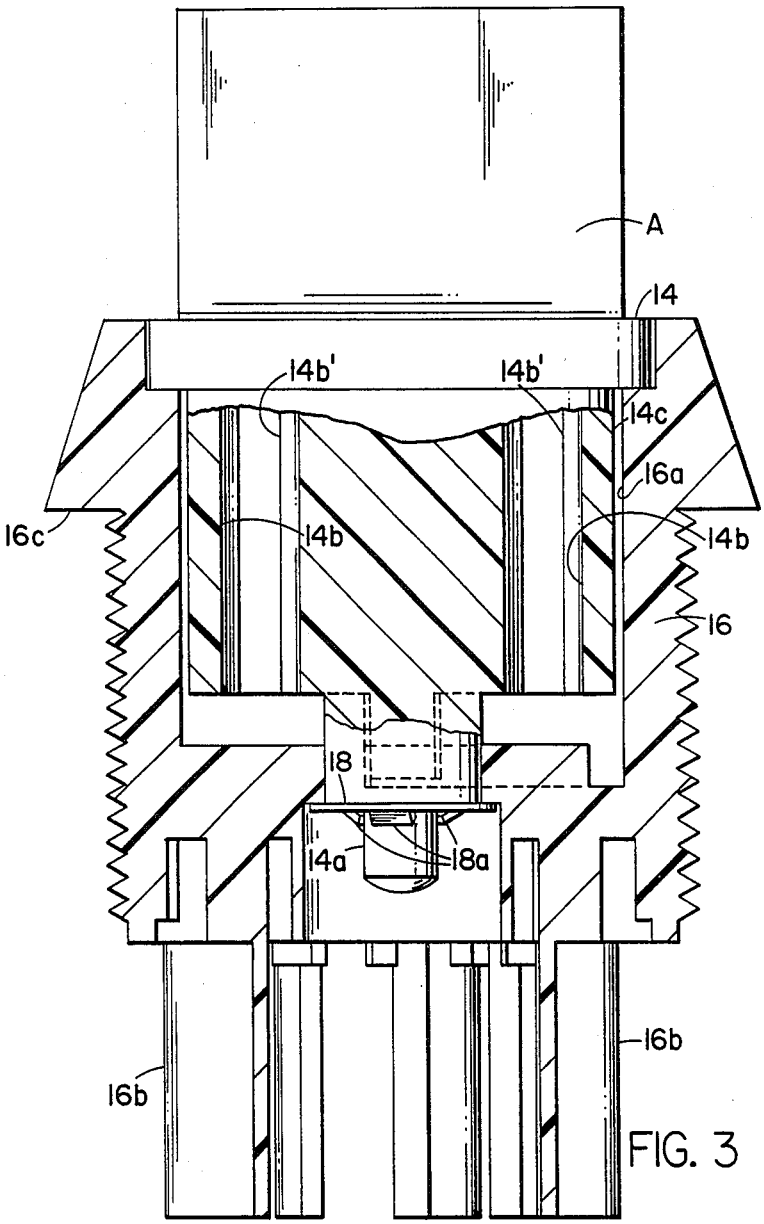
FIG. 3 is a side elevational view showing partly in section the elements of the FIG. 1 switch namely the body portion and control member or actuator, but without the metal fixed contacts and without the movable disc contacts illustrated for the switch of FIG. 1.
Figure 9:
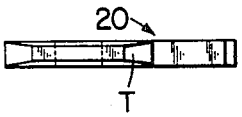
FIG. 9 is a bottom view of the fixed contact of FIG. 8.
Figure 8:
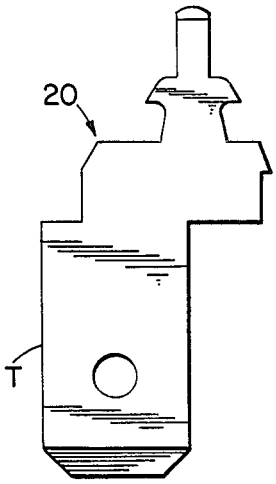
FIG. 8 is an elevational view of one fixed contact of the type used in the switch of FIGS. 1–13 inclusively.
Figure 12:
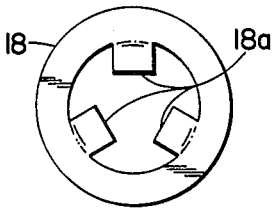
FIG. 12 is a plan view of a retaining ring used to secure the control member or actuator in the body portion as illustrated in FIGS. 1 and 3.
Figure 13:
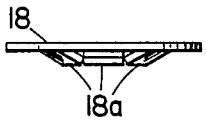
FIG. 13 is an end view of the retaining ring of FIG. 12.

Turning next to FIG. 3, the rotary actuator 14 can be seen to have a generally cylindrical shaped portion 14*c* that is rotatably received in a generally cylindrical upwardly open cavity 16*a* defined for it in the plastic body portion 16. These elements of the rotary switch are held in assembled relationship to one another by a retaining ring 18 that is received on a central depending post 14*a* of control member or actuator 14. The retaining ring 18 includes a peripheral portion that engages a downwardly facing flange provided for this purpose on the body portion 16. Further, the retaining ring 18 includes radially inwardly projecting tangs 18*a* which serve to engage the plastic material of the post 14*a* to hold these elements in assembled relationship. FIGS. 12 and 13 illustrate the retaining ring in greater detail.

Figure 2:
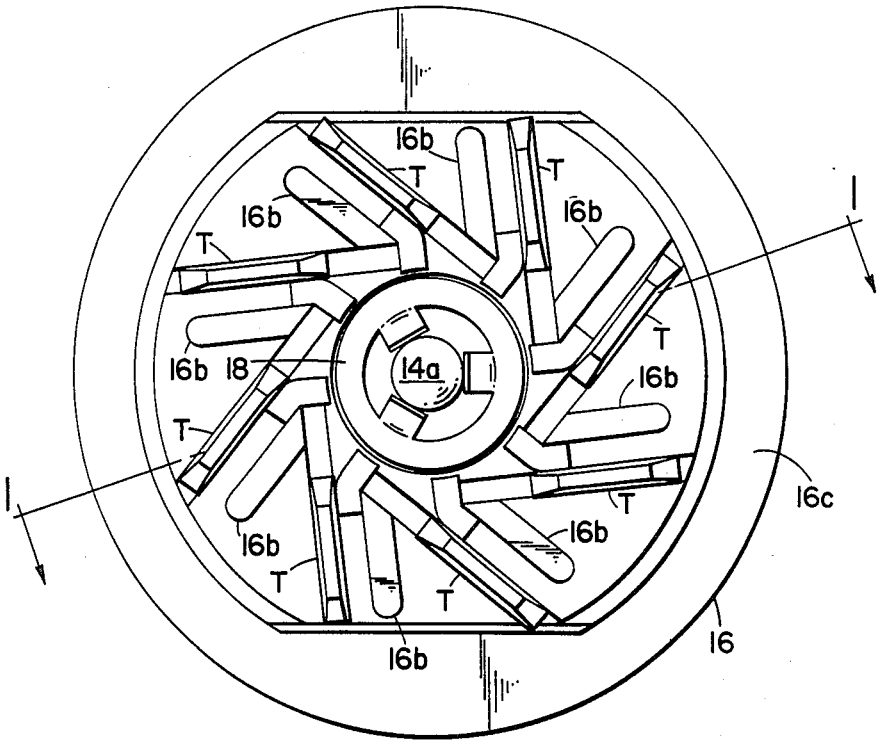
FIG. 2 is an end view showing the bottom of the switch illustrated in FIG. 1, FIG. 1 being taken generally on the line 1—1 of FIG. 2.

FIG. 2 illustrates in greater detail the bottom of the rotary switch of FIGS. 1 and 3, with the circumaxially spaced pattern of nested terminals being illustrated generally at T, T and these terminals being electrically isolated from one another by reason of depending walls 16*b*, which walls are integrally formed in the body portion 16 for this purpose. Preferably, and as best shown in FIG. 1 these depending walls 16*b* extend downwardly slightly beyond the lower ends of the terminals T, T so as to improve the dielectric effect achieved.

The generally cylindrical shaped body portion 16 is preferably formed from plastic to have the necessary dielectric properties, and may include an externally threaded cylindrical surface for receiving a nut as indicated generally at N in FIG. 1. This geometry permits the rotary switch of the present invention to be conveniently mounted from the front of a panel P in a suitably sized opening as shown. FIG. 2 illustrates the geometry for the opening such that the body portion 16 does not tend to rotate in the panel opening. The body portion 16 preferably includes a downwardly facing annular flange as shown at 16*c* for engaging the front of the panel P.

Figure 14:
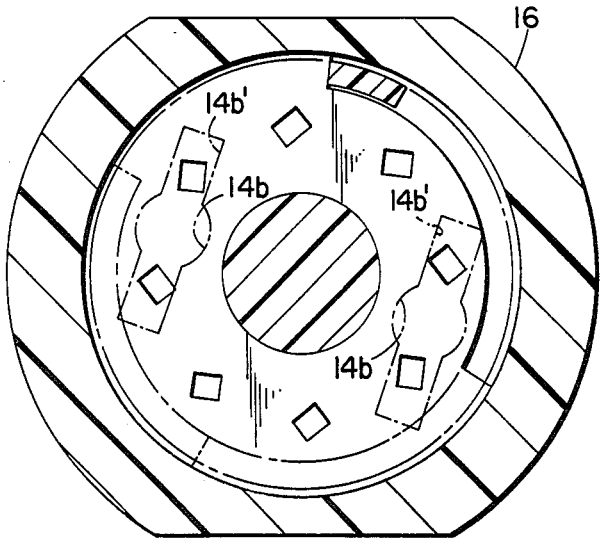
FIG. 14 is a sectional view of the switch shown in FIGS. 1–13 and illustrates a 90 degree range of rotational movement that is provided for the rotary control member or actuator as a result of the unique configuration for the stop means provided in part on the body portion and in part on the rotary control member itself.

The rotary control member or actuator 14 includes an upstanding portion A that is conveniently gripped by the user for altering the position of the rotary member in relationship to the body portion so as to achieve the desired switch condition. As the rotary control member is rotated two upstanding rotary discs 10 are caused to be moved around the longitudinal center line or axis of the body portion itself so that different switch conditions are achieved. As referred to previously, and as best shown in FIG. 4 each rotary disc 10 is adapted to be seated between adjacent upper end portions of the fixed contacts 20 as shown in that view to achieve a stable switch condition. However, rotation of the actuator A will cause the disc to roll over the top of one of these two adjacent fixed contacts until it is moved into contact with a third fixed contact achieving a different switch condition. Eight such fixed contacts are provided in the preferred form of the invention shown leading to at least four different switch conditions in the preferred form of rotary switch illustrated. In the double pole rotary switch version illustrated in FIG. 1 with two such movable contact discs 10, 10 are provided in two downwardly open recesses **14*b*, 14*b* provided for this purpose in the rotary actuator 14. In this particular double pole switch version three different switch conditions can be achieved, and the rotation of the actuator 14 is preferably limited in such a switch configuration to 90 degrees of rotation as suggested in FIG. 14 by suitable stop means. FIG. 14** shows suitable stop means, for providing for such 90 degree rotation.

Figure 14A:
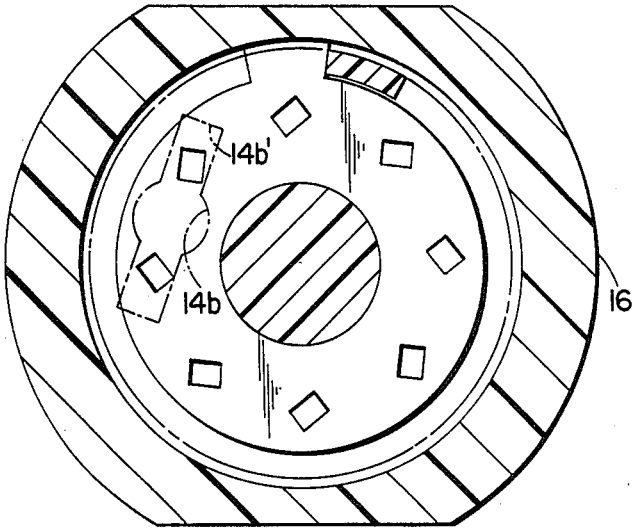
FIG. 14A shows a single pole switch with stop means for providing approximately 315 degrees of actuator rotation.

A single pole version is shown in FIG. 14A. With only one movable contact disc 10 up to eight different switch conditions are made possible with slightly less than 360 degrees of rotation being achieved as a result of the stop means shown. It will be apparent that intermediate switch configurations are made possible with intemediate stop surfaces being provided for in particular switch applications.

With particular reference to FIG. 4 the movable contact disc 10 is fabricated from a conductive material such as metal, and the contact disc 10 is biased downwardly by a retainer 22 having a lower surface shaped to engage the periphery of the disc 10 opposite the disc peripheral portion which serves to electrically connect the adjacent fixed contacts. Thus, the disc 10 is free to rotate on its axis (oriented radially to the housing 16) as the actuator A rotates on its vertical axis (oriented longitudinally relative the housing 16). Permissive rotation of the disc is achieved about its axis directed generally radially to the longitudinal axis of the switch itself, and this permissive rotation of the disc assures that electrical connection is made to the fixed contacts at successively different peripheral portions of the disc leading to longer switch life.

The retainer 22 comprises one element of biasing means that also includes a coil compression spring 24 acting between the downwardly facing inner wall of the recess **14*b* for the movable contact 10 and its retainer 22 and acting on the retainer 22** to achieve the downward biasing force required.

Figure 6:
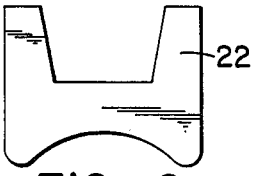
FIG. 6 is an elevational view of one element associated with the movable contact biasing means.
Figure 11:
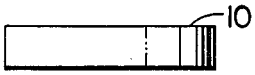
FIG. 11 is an end view of the contact disc of FIG. 10.
Figure 7:
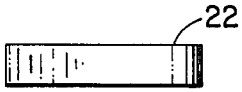
FIG. 7 is a bottom view of the element illustrated in FIG. 6.
Figure 5:
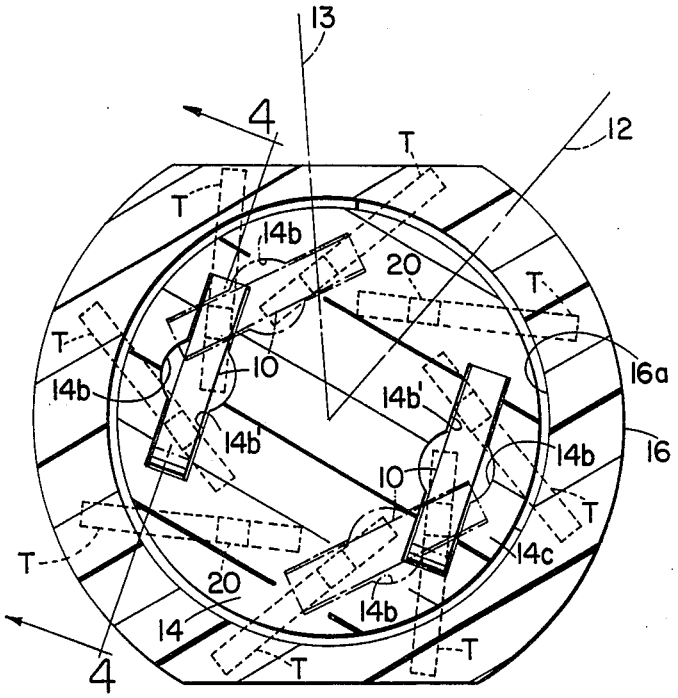
FIG. 5 is a horizontal section taken generally on the line 5—5 of FIG. 4.

The cross sectional shape for each of the downwardly open recesses provided in the actuator A is best shown in FIG. 5. In the two pole switch configuration shown each of these recesses **14*b*, 14*b* has a central cylindrical portion to receive the spring (not shown in FIG. 5) and each of these recesses further includes generally rectangular diametrically opposed notch portions 14*b*' for slidably receiving the retainer 22 (also eliminated from FIG. 5 for clarity) and disc 10. As the actuator 14 is rotated counterclockwise from the position shown in FIG. 5 through approximately 45 degrees the recesses 14*b*, 14*b* will move from the solid line position shown to the broken line positions of FIG. 5. This movement will cause each movable contact 10 to roll across the upper end of one of the two fixed contacts with which it is in engagement and achieve contact between one of these fixed contacts and another adjacent fixed contact. The rolling action of the contact disc 10 across the upper end of the fixed contact is accompanied by a lateral wiping or sliding motion as the contact 10 moves vertically in its recess 14*b* and rotates with member 14. This sliding or wiping action further serves to increase the life of the switch and to keep the upper ends of the fixed contacts 20, 20 and the peripheral portion of the contact disc free of oxidation and/or the build up of foreign material of any kind. FIG. 6 shows the retainer 22 in greater detail and when comparing FIG. 7 to FIG. 11 it will be apparent that the retainer 22 and disc 11 have the same general thickness and width (diameter) so as to facilitate translation of these elements within the recess 14*b*** of the actuator or control member.

It is an important feature of the invention that the movable contact disc 10 be biased downwardly so that a peripheral portion thereof rolls across the top of a fixed contact 20 and moves upwardly in its recess **14*b* against the force of said biasing means as the actuator A is rotated. The fixed contact upper ends are spaced above the bottom wall of the cavity 16*a* to allow this motion of the disc 10. This motion of the disc 10 provides a positive switch position as long as the disc is in contact with two adjacent fixed contacts as suggested in FIG. 4**.

Figure 15:
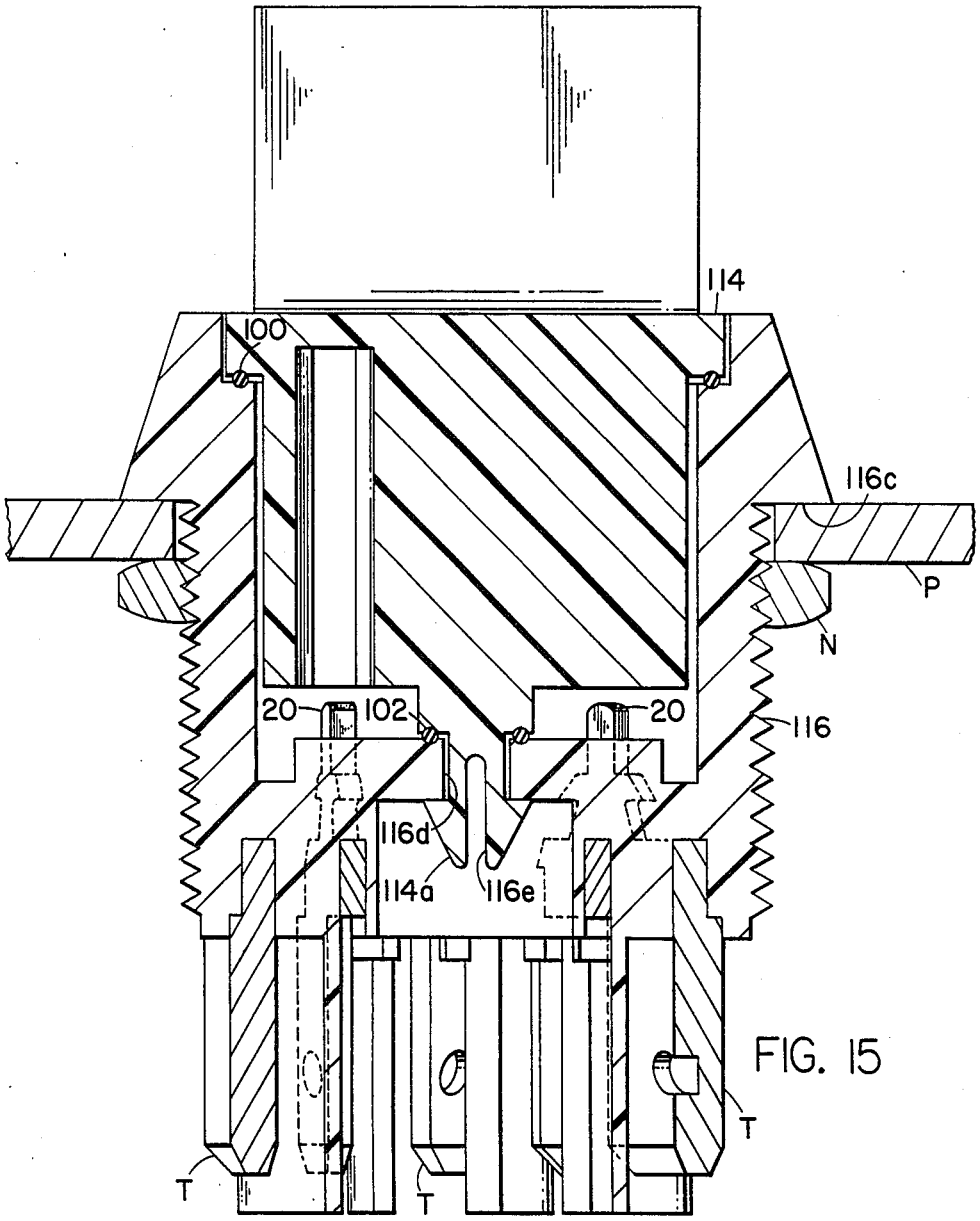
FIG. 15 is a vertical sectional view similar in many respects to the views of FIGS. 1 and 3, but illustrating a different means for interconnecting the control member or actuator with the body portion of the switch.

Turning next to a detailed description of the embodiment of the invention illustrated in FIG. 15, the general construction of the body portion 116 of FIG. 15 is similar to that illustrated in FIGS. 1–13. A smaller central opening **116*d* is provided to receive a depending post 114*a* of actuator 114, and this post 114*a* radially projecting flange defining post portions that are adapted to abut the adjacent downwardly facing annular flanged portion of the body 116 to hold the control member or actuator 114 in assembled relationship with the body portion 116. A slot 116*e* in post 114*a* allows the tapered end portion of post 114*a* to deflect these flange post portions inwardly during assembly. This construction avoids the necessity for a retaining ring such as that described previously with reference to FIGS. 12 and 13. O-rings 100 and 102 may be provided in the switch of FIG. 15 to isolate the interior contacts, both fixed and movable, from environmental contaminants or the like, and to assure that the member 114 is free to rotate in the body portion 116. The switch of FIG. 15 is otherwise similar to that described previously with reference to FIGS. 1–13 and can be adapted for use in a single or double pole switch configuration, and/or can be adapted for use in achieving predetermined degrees of rotation as described above with reference to FIGS. 14 and 14**A.

DETAILED DESCRIPTION OF FIG. 16

Figure 16:
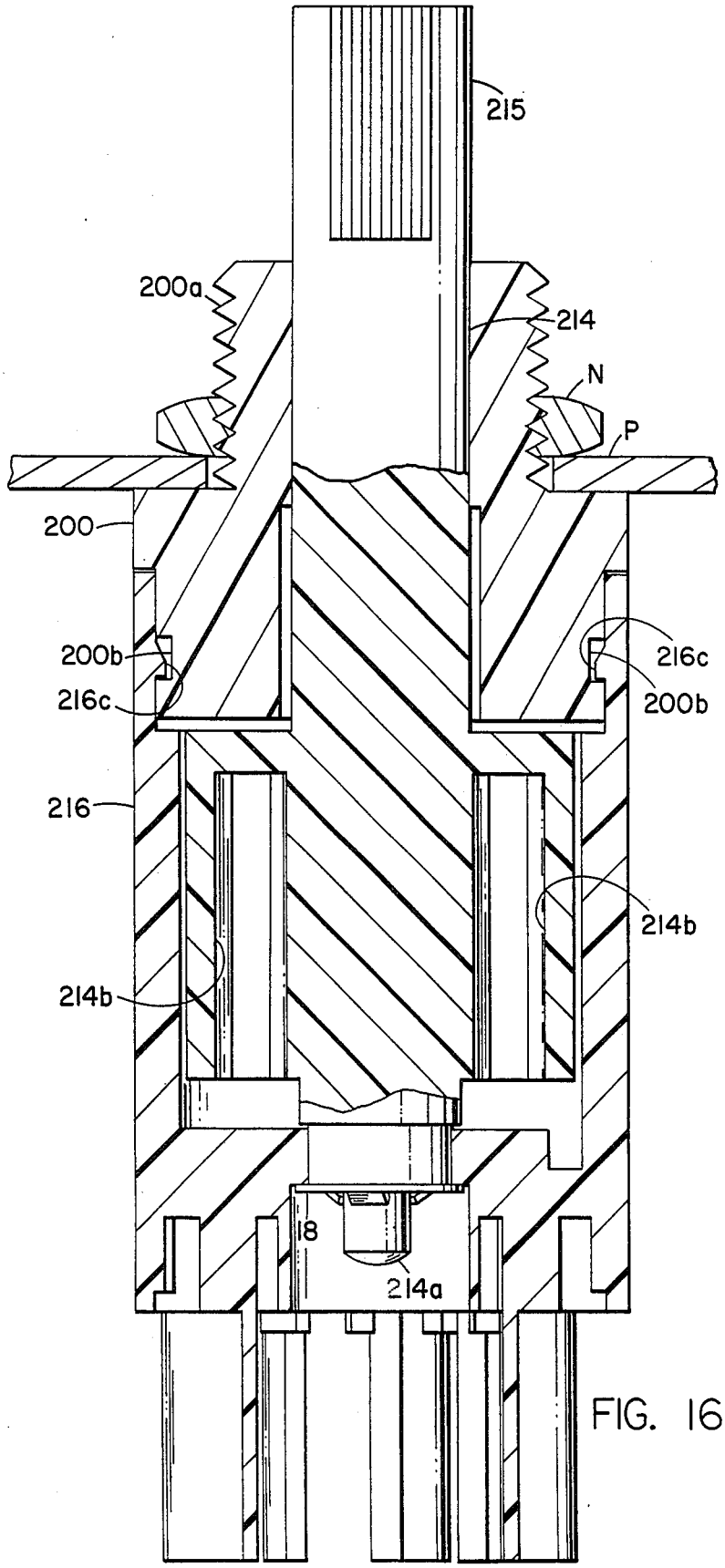
FIG. 16 is a vertical sectional view similar in many respects to that of FIG. 3 but illustrating a different configuration for the upper portion of the switch such that the body portion is defined by a cap which is assembled with the body portion to provide an upstanding boss that permits the switch to be conveniently attached to a panel, and which boss is also includes a through opening for the stem portion of the control member such that a knob or handle can be releasably secured to the stem.

Turning next to the embodiment of the invention illustrated in FIG. 16, the switch there shown is generally similar to that of FIGS. 1–13 except for the configuration of the upper portion of the switch body. Rather than a one-piece body portion as suggested at 116 in the switch of FIG. 15, FIG. 16 shows a body portion 216 that is adapted to receive a cap or cover portion 200. Which cover portion 200 defines a threaded boss **200*a* which rotatably receives a post 215 on the actuator 214. A knob or the like (not shown) is adapted to be conventionally mounted on this post 215. The switch of FIG. 16 can be mounted from the rear side of the panel P and a nut N provided on the threaded boss 200***a* to secure the switch in the panel P.

The cover portion 200 also includes several recesses 200*b* which are adapted to receive a radially inwardly projecting portions 216*c*, 216*c* provided on the inside of the cylindrical cavity of the body portion 216. These complementary shaped parts 200*b* and 216*c* are adapted to hold the cap portion 200 and body portion 216 in assembled relationship. While this means, defined in part on the body portion and in part on the cap portion, serves to secure these portions in assembled relationship, the control member or actuator 214 also includes a depending post 214*a* for receiving an annular retaining 18 similar to that described previously. Downwardly open recesses 214*b*, 214*b* are adapted to receive the biasing means for the contact discs (not shown) which selectively engage adjacent fixed contact upper end portions (also not shown) all of which elements are identical to those described previously with reference to the embodiment of FIGS. 1–13.

DETAILED DESCRIPTION OF FIG. 17

Figure 17:
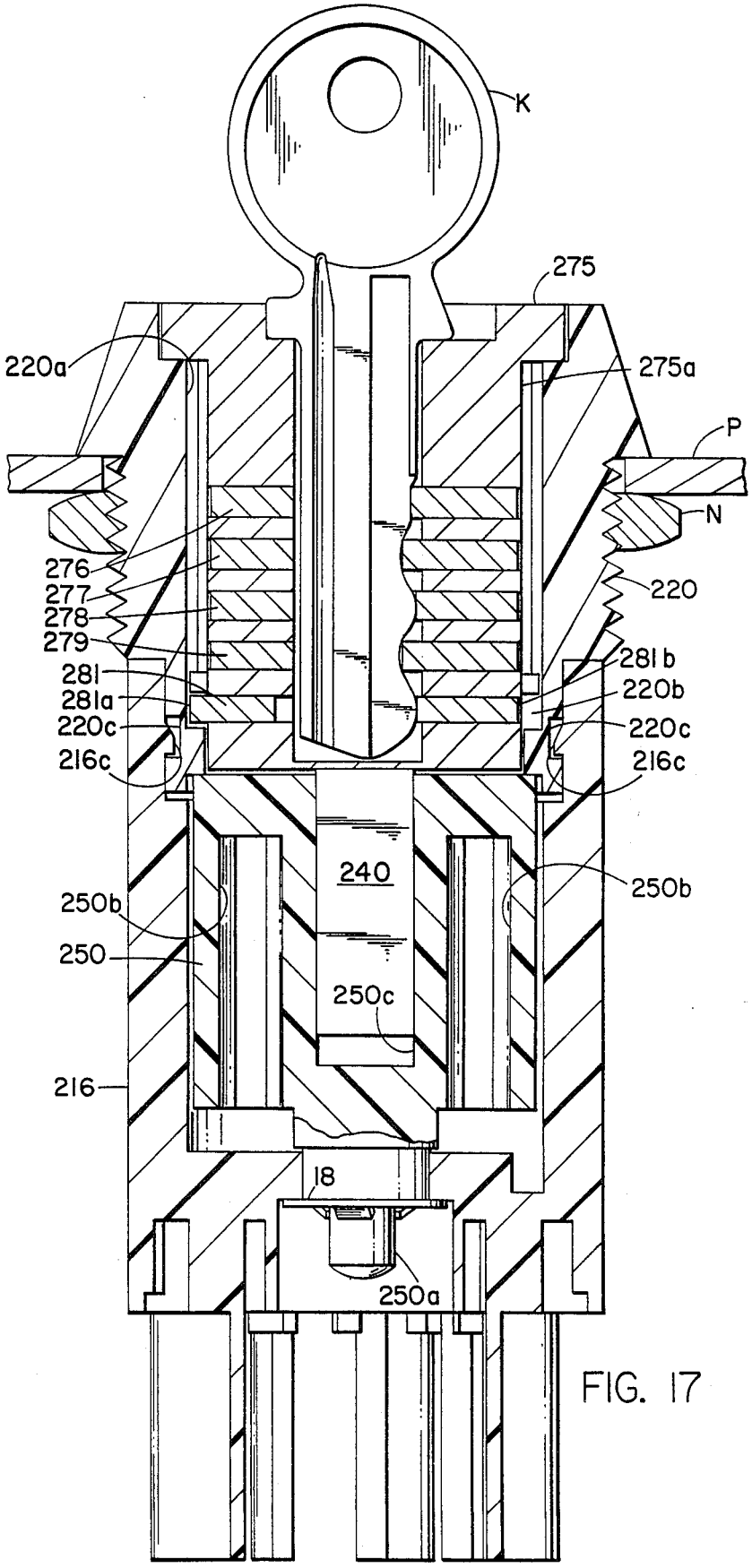
FIG. 17 shows a switch similar to that of FIG. 16 except that the upper cap portion of the body is adapted to be received in a panel opening from the front rather than from the rear of the panel, and so that the cap portion is adapted to receive a lock cylinder having a depending tang or cam for turning the rotary control member actuator only when the proper key is inserted in the cylinder lock and rotated.
Figure 22:
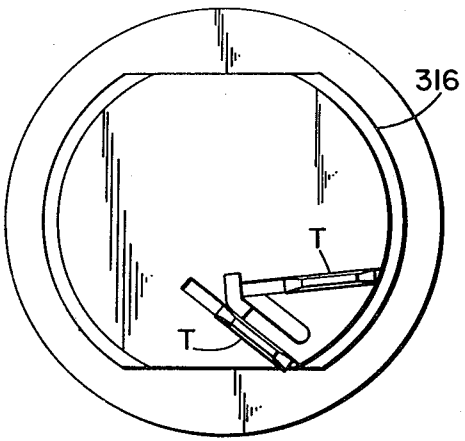
FIG. 22 is a bottom plan view of the switch illustrated in FIG. 18.

FIG. 17 illustrates a key operated switch version of the present invention that is generally similar to that of FIG. 16, similar parts being designated by similar reference numerals. In lieu of a cover portion, however, FIG. 17 shows an annular portion 220 having a central opening which is adapted to receive a conventional disc tumbler lock cylinder mechanism. The presently preferred lock cylinder mechanism differs slightly from that shown in FIG. 17 and will be described with reference to FIGS. 18–22. However, both versions include a plug 275 which is selectively rotatable in the annular portion 220 of the switch case as a result of inserting a key K as shown in FIG. 17. In accordance with conventional disc tumbler lock cylinder design the selectively rotatable plug 275 has an axially extending slot to receive the key K and the key has at least one edge adapted to shift the discs or wafers so that each wafer 276, 277, 278 and 279 has its end portions within the outer circumference 275*a* of the plug 275. Each wafer is spring biased (toward the left in FIG. 17) and the key shifts the wafers (toward the right in FIG. 17) to achieve the configuration shown. When key K is withdrawn these wafers 276–279 are biased by individual springs (not shown) so that their left hand end portions project beyond surface 275*a* and into one of several vertically extending slots 220*a* provided in the inside wall of switch case portion 220. The innermost or bottom wafer 281 is not shifted by key K and remains in its biased position to provide a convenient means for securing the lock cylinder 275 in the case or cover portion 220 of the switch housing. The inside wall of the switch case defines an annular slot 220*b* for receiving one end 281*a* of the innermost wafer 281 as shown in FIG. 17. The opposite end 281*b* of this wafer 281 is somewhat smaller than the end 281*a* and can pass through a small gap in the upper rib forming slot 220*b* to allow assembly (or disassembly) of the lock cylinder with (or from) the switch case 220. The lock cylinder has a tang 240 that fits into slot 250*c* in the actuator 250 in order that rotation of a proper key K will operate the switch. The configuration of the lock cylinder with the several wafers operable as described above is conventional and such cylinders are available from several manufacturers including ESP (Engineered Security Products) of Leominster, Mass. This company sells such a lock under Model No. 625 (Series). The actuator or control member 250 serves much the same purpose as the control member 214 of the FIG. 16 switch in that rotation of this member 250 will achieve selective changes in the switching configuration of the terminals (not shown in this view). Downwardly open recesses 250*b* are provided to receive the biasing means and movable contact disc which selectively engage the upper ends of the fixed contacts. Each of these various elements may be identical to those described previously with reference to the embodiment of FIGS. 1–13 and are not shown in FIG. 17 so that the configuration of the control member 250 can be better understood.

Cap portion 220 has a lower portion adapted to be received in the upper cylindrical portion of the cavity in the body portion 216. More particularly, the mating portions of the cap 220 and body 216 define an annular groove 220*c* and internally facing rib 216*c* respectively which permit these members to be assembled with one another but which configuration for the rib 216*c* tends to prevent inadverent disassembly of these components.

As so constructed and arranged insertion of key K will permit rotation of the internal lock cylinder part and cause rotation of the member 250.

DETAILED DESCRIPTION OF FIGS. 18–22

Figure 18:
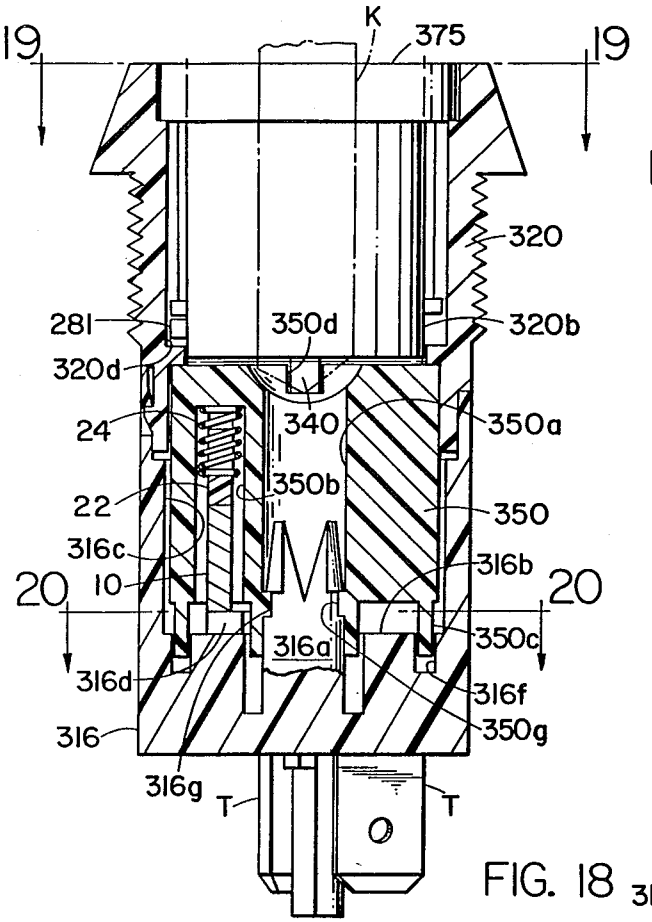
FIG. 18 shows a single pole ON/OFF key switch similar to that of FIG. 17 except for the more compact configuration for securing the lock cylinder in place and coupling it to the rotary actuator or control member, and but for the geometry of the restraining means to prevent axial movement of the actuator. The switch "OFF" condition is shown.

The switch of FIGS. 18–22 like that of FIG. 17 discussed above, is key operated and has a lock cylinder 375 similar to that of the cylinder 275 but for the configuration of the mating parts between the actuator 350 of FIG. 18 and that described above with reference to FIG. 17 at 250.

Actuator 350 has no central depending post such as that shown at 250*a* in FIG. 17. Instead, actuator 350 has a central bore 350*a* for receiving an upstanding post 316*a* provided integrally with the bottom wall 316*b* of the switch base 316. This post 316*a* is formed very much like the post 116*a* of actuator 116 in FIG. 15 and serves much the same purpose. Post 316*a* as a circumferential slot 316*g* and rotatably supports an annular flange 350*g* actuator 350 while restraining it from movement axially in the upwardly open cylindrical cavity defined by the switch case base portion 316. Post 316*a* has radially deformable post portions similar to those referred to previously with reference the embodiment of FIG. 15 that deflect inwardly at assembly and as a result of the slot 316*g* and flange 350*g* serve to restrain the actuator from movement axially relative to the base portion once these components are assembled.

In the single pole switch version shown in FIG. 18 only one downwardly open recess 350*b* is provided for the disc contact 10 and biasing means 22/24. As in the embodiments described previously disc 10 rolls across the upper end of each fixed contact when the key is caused to rotate the actuator 350 in the cavity 316*c*. As the disc comes into contact with two adjacent fixed contacts (see FIG. 1) a stable switch "ON" position or condition is provided. In order to provide a switch "OFF" position or condition in the switch of FIG. 18 the bottom wall 316*b* of the cavity 316*c* is provided with two circumferentially spaced lobes 316*d* and 316*e*, best shown in FIGS. 20 and 21. The actuator is shown in a switch "OFF" position in FIG. 20 and in a switch "ON" position in FIG. 21. These lobes 316*d* and 316*e* are raised above the floor of the bottom wall 316*b* of the cavity 316*c* so as to correspond in height to the tops of fixed contacts 20, 20. The lobes 316*d* and 316*e* are somewhat larger than the fixed contacts to prevent premature wearing away of the plastic material during the life of the switch.

Figure 19:
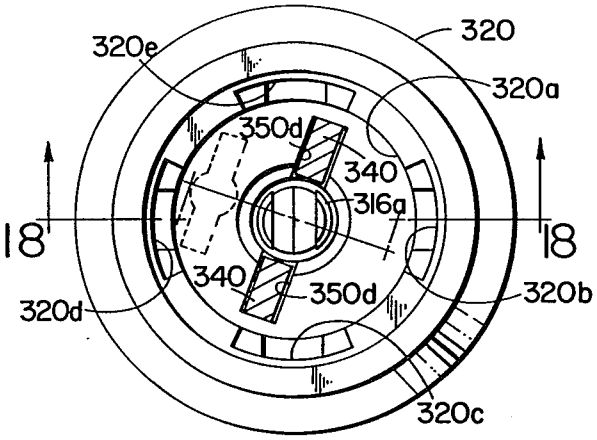
FIG. 19 is a horizontal section taken on the line 19—19 of FIG. 18.
Figure 21:
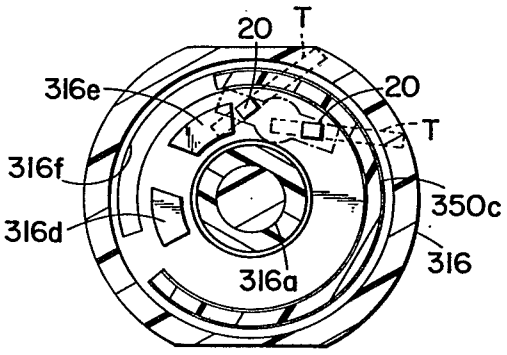
FIG. 21 is a view similar to FIG. 20 but showing the single pole switch in its "ON" condition.
Figure 20:
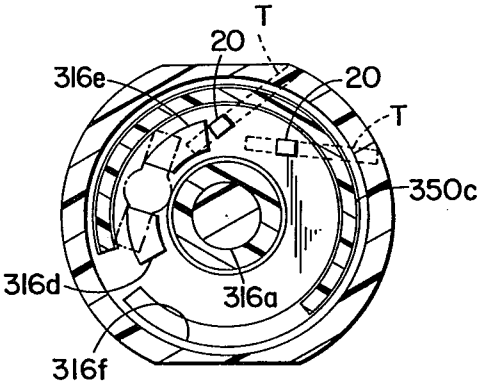
FIG. 20 is a horizontal section on the line 20—20 of FIG. 18 of FIG. 18.

The key switch of FIGS. 18–22 need only provide for rotation of the key and the coupled lock cylinder and actuator through 90 degrees to achieve the above described "ON/OFF" switch conditions. Consequently, and as shown in FIGS. 20 and 21 the stop means, defined in part by depending skirt 350*c* and in part by an upwardly open slot 316*f* in the actuator 350 and switch base portion 316 respectively, is so configured that rotary motion of the actuator is so limited. Other rotary limits can be provided for by reducing the circumferential extent of this skirt 350*c*, and the switch base portion 316 can be provided in the configuration shown for all switch rotational requirements. That is, switch rotational limits can be varied between the 90 degrees shown to other multiples of the 45 degree travel between adjacent switch positions or conditions.

FIG. 19 shows the fixed cap or cover portion 320 of the switch case and also shows the inside surface 320*a* as generally cylindrical but with diametrically opposed grooves or slots 320*b*, 320*c*, 320*d* and 320*e*. These slots are like those described above with reference to FIG. 17 in that they receive the slidable wafers of the lock cylinder to restrict rotation of the cylinder, and therefor of the actuator when key K is not in place. As in the switch of FIG. 17 the innermost wafer 281 remains in its annular groove or slot 320*d* to hold the lock cylinder in place until released by a master key according to conventional disc tumbler lock technology. While two diametrically opposed pairs of grooves are shown in FIG. 19 the second pair serves only to provide the capability of removing the key in the switch "ON" position (that is after rotating the key 90 degrees from that of FIGS. 18 and 20 to the "ON" position of FIG. 21). If a particular switch application should require that key removal be precluded in the switch "ON" position one could simply insert plastic fillers in the second pair of slots 320*c* and 320*e* or provide a switch case upper portion 320 without such a second pair of slots.

FIG. 19 also shows an alternative means for coupling the lock cylinder 375 to the rotary actuator 350. Instead of a single tang such as shown in the FIG. 17 switch at 240 on lock cylinder 275, the switch of FIGS. 18–22 has two smaller tangs 340, 340 that are received in a diametrically extending slot 350*d* of actuator 350. This geometry permits lock cylinder 375 to be of somewhat shorter axial extent than that of FIG. 17 because the end of the key K can project between these tangs 340, 340 and such a situation cannot occur with the axially located tang of FIG. 17.

We claim:

1. A rotary switch comprising a generally cylindrical dielectric body portion defining an upwardly open cavity of generally cylindrical shape, said cavity having a longitudinal axis, said body portion having a bottom wall defining a plurality of circumaxially spaced openings, fixed contacts provided in at least some of said openings such that upper ends thereof are spaced radially between said cavity axis and the cylindrical cavity wall, said fixed contact upper ends spaced above said bottom wall, a generally cylindrical dielectric control member rotatably received in said cylindrical cavity, means for restraining said control member from movement axially in said cavity, said control member having at least one downwardly open generally rectangularly shaped recess, said recess spaced radially from said axis a distance corresponding to the radial spacing of said fixed contact upper ends, a disc shaped movable contact so provided in said recess that said disc contact is free to rotate on its own central axis to provide a first peripheral portion of said disc contact in abutting relationship to adjacent fixed contact upper ends, and means located in said recess for biasing said disc contact downwardly toward said fixed contact upper ends, said disc contact being movable upwardly in said recess against the force of said biasing means as said control member is rotated out of contact with one of said adjacent fixed contact upper ends and said disc contact caused to rotate over the upper end of the other adjacent fixed contact upper end.

2. The rotary switch of claim 1 wherein said means for biasing said disc contact comprises a retainer also slidably received for translation in said recess and having a concave lower surface for engaging another portion of said disc periphery opposite said first mentioned portion, and a compression spring also provided in said recess and acting on said retainer to urge it and said disc contact toward said fixed contact upper ends.

3. The rotary switch of claim 1 wherein said fixed contacts comprise flat metal components, each such flat component having a lower portion protruding below said bottom wall of said body portion for connection to a conductive lead, and each such component having an upper portion offset radially inwardly from said lower portion to define said fixed contact upper end at a radial distance at least approximately equal to one-fourth the diameter of said body portion.

4. The rotary switch of claim 3 wherein said flat fixed contact components are provided in equally spaced circumaxial relationship in said body portion, each such contact component being oriented at approximately 45 degrees with respect to a radial direction through its upper end.

5. The rotary switch of claim 1 further characterized by an upper cap portion for said body portion, means defined in part by said cap portion and in part by said body portion for holding said portions in assembled relationship, said control member being rotatably supported therebetween.

6. The rotary switch of claim 1 wherein said control member has a depending central post received in a central bore defined by said body portion bottom wall, and said means for restraining said control member comprising retaining means securing said post against movement axially upwardly relative said bore.

7. The rotary switch of claim 6 wherein said body portion has a generally annular flange defining a downwardly facing seating surface for engaging the front face of a panel in which the switch is to be mounted, and said control member having a knob defining portion projecting upwardly of said flange defining portion of said body portion.

8. The rotary switch of claim 5 wherein said cap portion defines an externally threaded upstanding boss of smaller diameter than said switch body portion and adapted to be received in a panel opening such that an upwardly facing annular seating surface at the base of said boss abuts the underside of the panel.

9. The rotary switch of claim 4 wherein said lower component portions have outer edges describing a closed surface of generally cylindrical configuration with a diameter approximately equal to that of said body portion.

10. The rotary switch of claim 9 wherein at least eight fixed contact components are provided in equally spaced circumaxial relationship in said body portion.

11. The rotary switch of claim 9 further characterized by integrally molded depending dielectric barriers in said body portion bottom wall between each of said flat component lower portions.

12. The rotary switch of claim 11 wherein said integrally molded barriers are more particularly defined by walls of approximately the same thickness (t) as that of said flat components, and wherein said barrier walls are oriented parallel to and spaced from said component lower portions by a dimension at least approximately equal to said thickness (t).

13. The rotary switch of claim 11 wherein said means for biasing said disc contact comprises a retainer also slidably received for translation in said recess and having a concave lower surface for engaging another portion of said disc periphery opposite said first mentioned portion, and a compression spring also provided in said recess and acting on said retainer to urge it and said disc contact toward said fixed contact upper ends.

14. The rotary switch of claim 2 wherein said fixed contacts comprise flat metal components, each such flat component having a lower portion protruding below said bottom wall of said body portion for connection to a conductive lead, and each such component having an upper portion offset radially inwardly from said lower portion to define said fixed contact upper end at a radial distance at least approximately equal to one-fourth the diameter of said body portion.

15. The rotary switch of claim 14 further characterized by an upper cap portion for said body portion, means defined in part by said cap portion and in part by said body portion for holding said portions in assembled relationship, said control member being rotatably supported therebetween.

16. The rotary switch of claim 15 further characterized by a lock cylinder provided in said cap portion, said lock cylinder being selectively rotatable in said cap portion, and means coupling said lock cylinder to said rotary control member for rotational movement therewith.

17. The rotary switch of claim 14 wherein said control member has a depending central post received in central bore defined by said body portion lower wall, and said means for restraining said control member comprising a retaining means securing said post against movement axially upwardly relative of said bore.

18. The rotary switch of claim 17 wherein said body portion has a generally annular flange defining a downwardly facing seating surface for engaging the front face of a panel in which the switch is to be mounted, and said control member having a knob defining portion projecting upwardly of said flange defining portion of said body portion.

19. The rotary switch of claim 14 wherein said cap portion defines an externally threaded upstanding boss of smaller diameter than said switch body portion and adapted to be received in a panel opening such that an upwardly facing annular seating surface at the base of said boss abuts the underside of the panel.

20. The rotary switch of claim 14 wherein said flat fixed contact defining components are provided in equally spaced circumaxial relationship in said body portion, each such component being oriented at approximately 45 degrees with respect to a radial direction through its upper end.

21. The rotary switch of claim 5 wherein said cap portion defines a boss, a stem defined by said control member and projecting through an opening in said boss and adapted to receive a knob.

22. The rotary switch of claim 5 wherein said cap portion defines a centrally located lock cylinder receptacle, and a lock cylinder secured in said lock cylinder receptacle, said lock cylinder being selectively rotatable in said lock cylinder receptacle, and coupling means between said lock cylinder and said control member to rotate the control member in response to selective rotation of said lock cylinder.

23. The rotary switch of claim 22 wherein said cap portion has an external annular flange, said cap portion defining an external thread for receiving a threaded nut to secure the switch in a panel opening.

24. The rotary switch of claim 1 wherein said control member has a central bore and said bore further defines an annular flange surface, said body portion having an upstanding post in its bottom wall, said post rotatably receiving said control member central bore, and said means for restraining said control member from movement axially comprising radially deformable post portions engageable with said annular flange surface.

25. The rotary switch of claim 24 further characterized by an upper cap portion for said body portion, means defined in part by said cap portion and in part by said body portion for holding said portions in assembled relationship, said control member being rotatably supported therebetween.

26. The rotary switch of claim 25 wherein said means for holding said cap and body portions in assembled relationship comprises one of said portions telescopically received inside the other portion, circumaxially spaced projections on the inside portion said projections received in circumaxially spaced openings in the outside portion.

27. The rotary switch of claim 26 further characterized by an upper cap portion for said body portion, means defined in part by said cap portion and in part by said body portion for holding said portions in assembled relationship, said control member being rotatably supported therebetween.

28. The rotary switch of claim 25 wherein said means for holding said cap and body portions in assembled relationship comprises one of said portions telescopically received outside the other portion, circumaxially spaced projections on the outside portion said projections received in circumaxially spaced openings in the inside portion.

29. The rotary switch of claim 1 wherein said control member has a depending stop spaced radially from the axis of rotation of said control member, and said body portion bottom wall having a partially circular slot for receiving said stop, said slot having ends for restricting the angular degree of rotation of said control member.

30. The rotary switch of claim 1 wherein said body portion bottom wall has at least one integrally defined land corresponding generally in height above said bottom wall to the height at which said fixed contact upper ends are spaced above said body portion bottom wall.

31. The rotary switch of claim 1 further characterized by an upper body portion defining a lock cylinder receptacle, a lock cylinder in said receptacle and selectively rotatable therein, means coupling said lock cylinder to said control member for rotation in response thereto, and means defined in part by said upper body portion and in part by said body portion for holding said respective body portions in assembled relation.

32. The rotary switch of claim 31 wherein said upper body portion has a top bezel portion for abutting the front face of a panel in which the switch is to be mounted, said upper body portion having a bottom part defining said means for holding said body portions in assembled relation, and at least two internally defined axially extending slots for receiving said lock cylinder tumblers to prevent rotation of said lock cylinder except when fitted with a proper key.

33. The rotary switch of claim 32 wherein said control member has a central bore and said bore further defines an annular flange surface, said body portion having an upstanding post in its bottom wall, said post rotatably receiving said control member central bore, and said means for restraining said control member central from movement axially comprising radially deformable post portions engageable with said annular flange surface.

34. The rotary switch of claim 33 wherein said means for holding said cap and body portions in assembled relationship comprises one of said portions telescopically received inside the other portion, circumaxially spaced projections on the inside portion said projections received in circumaxially spaced openings in the outside portion.

35. The rotary switch of claim 33 wherein said means for holding said cap and body portions in assembled relationship comprises one of said portions telescopically received outside the other portion, circumaxially spaced projections on the outside portion, said projections received in circumaxially spaced openings in the inside portion.

36. A key switch comprising a base, and a housing, means defined in part by said base and in part by said housing for securing said housing to said base, said base and housing defining an elongated cylindrical cavity having a circumferentially extending side wall and a bottom wall, an actuator rotatably supported in said cavity and having a lower end adjacent said bottom wall, fixed contacts in said bottom wall, means for restaining said actuator from axial movement in said cavity, said actuator lower end having a recess, a rotatable disc shaped contact element in said actuator recess, means biasing said disc toward said bottom wall and into engagement with said fixed contacts, a lock cylinder rotatably supported in said cavity and having a lower end drivingly connected to said actuator end opposite said lower end, said lock cylinder having projecting portions selectively received in slots defined at said cylindrical cavity circumferentially extending cavity side wall.

37. A key switch of claim 36 wherein said lock cylinder has at least one projecting portion permanently received in an annular slot provided for it in said cylindrical cavity circumferential side wall adjacent said inner lower end of said lock cylinder to permit lock cylinder rotation as a result of use of a proper key while preventing lock cylinder movement axially in said cylindrical cavity except as a result of use of a master key.

38. A key switch of claim 37 wherein said means for restraining said actuator from axial movement comprises means defined in part by said actuator and in part by said base.

39. A key switch of claim 38 wherein only said housing and base define said lock cylinder and actuator cavity.

* * * * *